United States Patent [19]

Roznieckí

[11] 4,121,666

[45] Oct. 24, 1978

[54] FUEL (FLAMMABLE LIQUID) TANK FIRE EXTINGUISHER

[75] Inventor: Edward J. Roznieckí, St. Clair Shores, Mich.

[73] Assignee: The United States Government as represented by the Secretary of the Army, Washington, D.C.

[21] Appl. No.: 786,737

[22] Filed: Apr. 11, 1977

[51] Int. Cl.[2] ..... A62C 35/12

[52] U.S. Cl. ..... 169/62; 169/66; 220/426; 220/88 R

[58] Field of Search ..... 169/62, 66; 220/63 A, 220/88 R, 88 A, 88 B

[56] References Cited

U.S. PATENT DOCUMENTS

| | | | |
|---|---|---|---|
| 2,301,483 | 11/1942 | Van Daam | 169/62 X |
| 3,738,428 | 6/1973 | Ingro | 169/62 X |
| 3,827,455 | 8/1974 | Lee | 220/88 R X |
| 3,930,541 | 1/1976 | Bowman et al. | 169/62 |

*Primary Examiner*—Johnny D. Cherry

*Attorney, Agent, or Firm*—Peter A. Taucher; John E. McRae; Nathan Edelberg

[57] ABSTRACT

In a military vehicle having an upright fuel tank, an improved hollow panel containing pressurized fire-suppressant, the panel being located so that the suppressant sprays through an opening formed in the panel by an enemy projectile after its passage through the fuel tank. The hollow panel is reinforced against premature bursting forces by the provision of internal partitions running parallel to the major axis of the panel; the major walls of the panel are curved or bowed parallel to the minor axis of the panel to further reinforce the panel against premature bursting.

1 Claim, 5 Drawing Figures

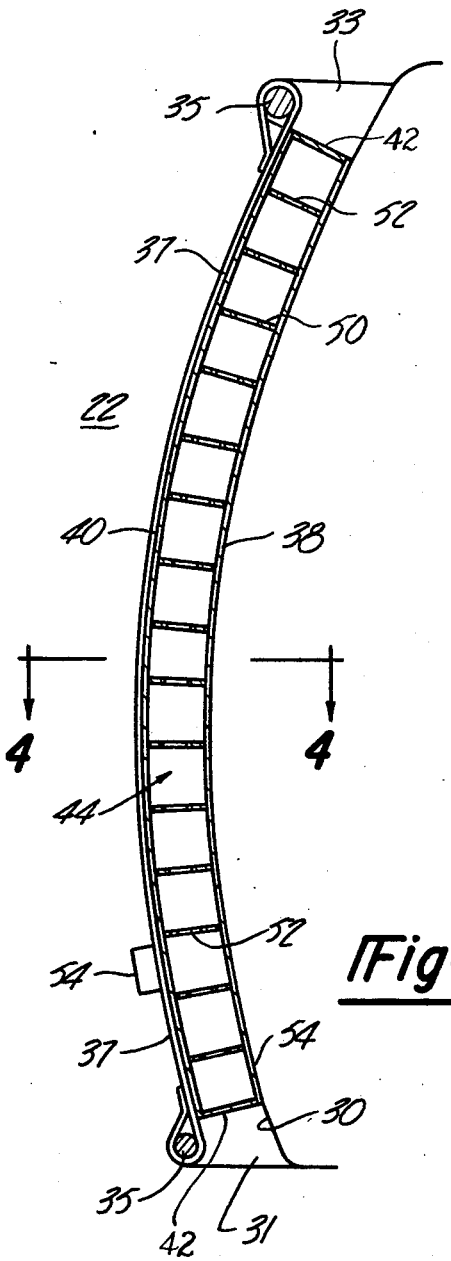
Fig-3
Fig-4
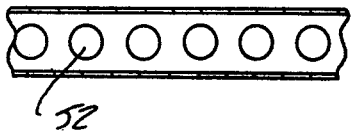
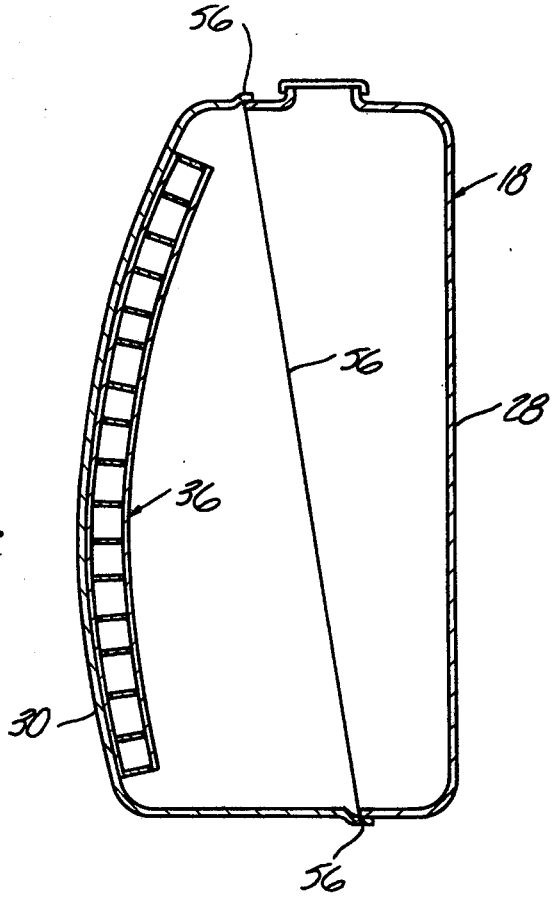
Fig-5

FUEL (FLAMMABLE LIQUID) TANK FIRE EXTINGUISHER

The invention described herein may be manufactured, used, and licensed by or for the Government for governmental purposes without payment to me of any royalty thereon.

BACKGROUND AND SUMMARY OF THE INVENTION

U.S. Pat. No. 3,930,541 to Bowman et al discloses a hollow panel structure positionable in near adjacency to a military fuel tank for discharging fire-suppressant material through the opening formed by an enemy projectile. U.S. Pat. No. 3,915,237 to the present inventor, E. J. Rozniecki, discloses a charged bottle having an improved passage structure for discharging fire-suppressant toward the fireball resulting from penetration of enemy projectiles into the vehicle. Both of these patented inventions are directed broadly to mechanisms for rapidly directing the suppressant toward the fireball (flame source), to thereby extinguish the fireball before it engulfs the engine compartment or personnel compartment. The present invention is directed toward further reducing the time required to deliver the fire-suppressant to the fireball.

The present invention comprises a hollow panel containing pressurized fire-suppressant at a relatively high pressure, e.g. 900 p.s.i. The panel is prevented from premature rupture by two reinforcement methods or devices. One reinforcement device consists of a series of partitions running parallel to the major dimension of the panel. A second reinforcement action is achieved by bowing or curving the panel walls along the minor axis dimension of the panel. A special feature of the invention resides from the fact that each partition is formed with a row of ports along its length so that the entire space within the panel constitutes essentially a single chamber. The single chamber design is important in promoting a fast high volume flow of suppressant to the opening formed by the enemy projectile. The high flow rate helps to rapidly extinguish the fireball within a relatively short elapsed time, e.g. 100 milliseconds or less.

THE DRAWINGS

FIG. 3 is an enlarged view taken in the same direction as FIG. 1.

FIG. 4 is a fragmentary view taken on line 4—4 in FIG. 3.

FIG. 5 is a sectional view taken through another fuel tank incorporating the invention.

Figure 1:
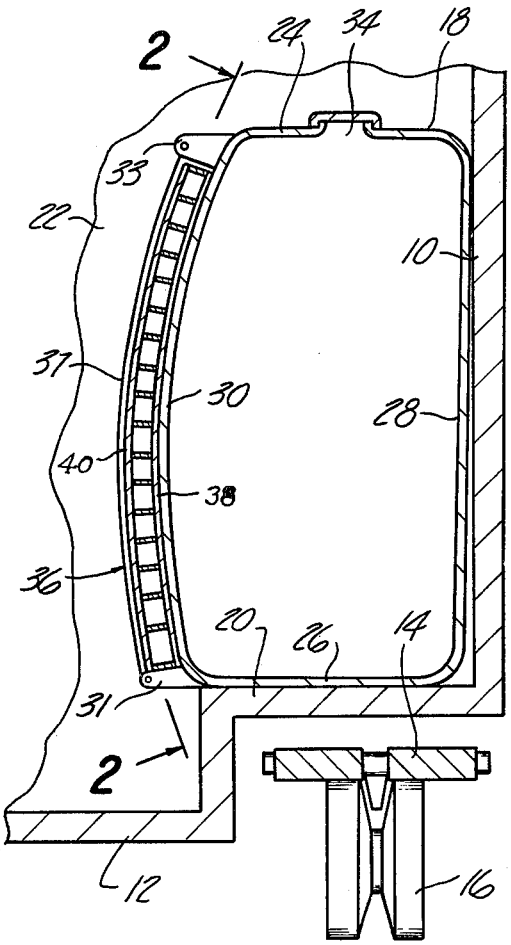
FIG. 1 is a fragmentary sectional view taken through the fuel tank of a military vehicle utilizing this invention.
Figure 2:
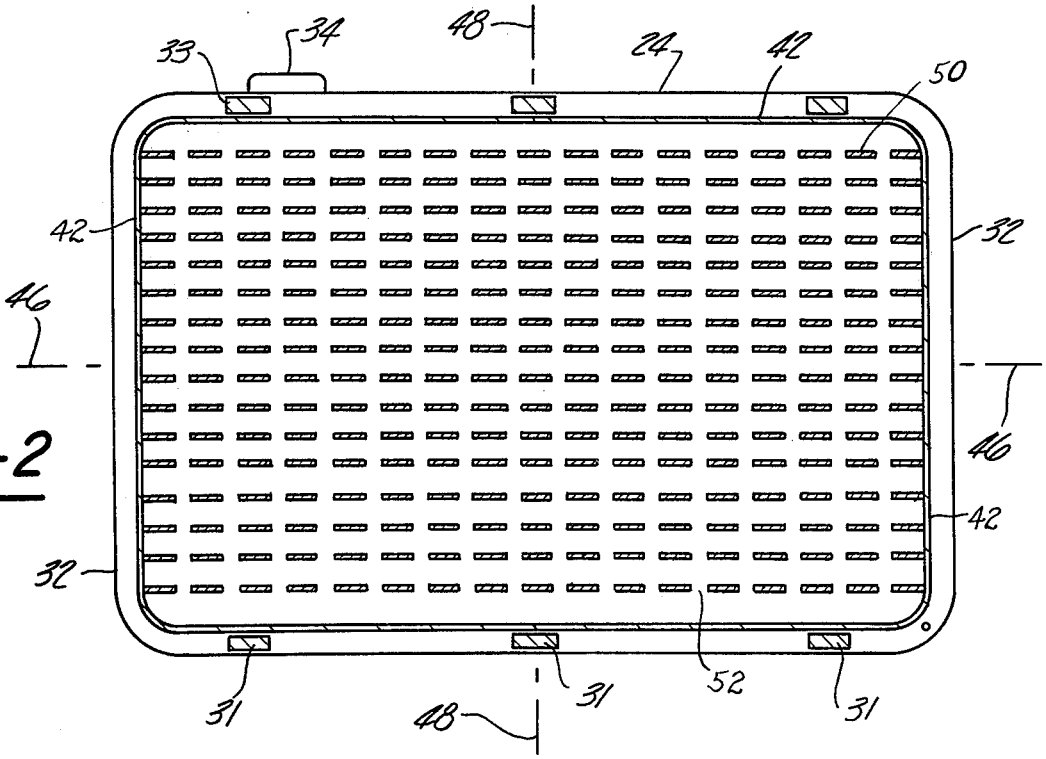
FIG. 2 is a sectional view taken on line 2—2 in FIG. 1.

FIG. 1 fragmentarily illustrates a military vehicle of the personnel carrier type. The vehicle comprises a sidewall 10, a bottom wall 12, and a shelf wall 20. The upper run of an endless track 14 moves over return rollers 16 located below shelf 12; the lower run of the track is not visible in the drawings. Positioned within the vehicle above shelf 20 is a fuel tank 18. The section of shelf 20 not occuppied by the fuel tank forms a seating area for personnel. Free area 22 constitutes an aisle for enabling military personnel to move to or from a ramp-type closure at the rear of the vehicle.

Fuel tank 18 is of generally rectangular construction comprising a top wall 24, a bottom wall 26, an essentially flat major sidewall 28, a curved or bowed major sidewall 30, and end walls 32. A filler opening 34 is provided in top wall 24. The present invention relates to a hollow panel 36 positioned in near adjacency to tank wall 30. The panel includes first and second parallel bowed walls 38 and 40 connected at or near their peripheral edges by an endless strip 42, said strip forming a border or frame that seals the circumscribed space 44 between walls 38 and 40. The panel has an imaginary major axis 46 in the longest dimension of the panel and a minor axis 48 in a shortest transverse direction of the panel.

Walls 38 and 40 of panel 36 are bowed in directions paralleling the minor axis 48 to thereby reinforce the hollow panel against blow-out or bursting stresses that would propagate cracks along lines paralleling axis 48. The panel is reinforced in directions paralleling the major axis 46 by means of internal partitions or ribs 50 running parallel to axis 46. Each partition has one edge welded to wall 38 and a second edge welded to wall 40, preferably by the known electron beam welding process. Such a process is accomplished under vacuum with electron guns targeted on the edges of partitions 50 from stations alongside the outer faces of walls 38 and 40. The width of the weld is relatively small but the depth of the weld is relatively great; therefore relatively thin partitions 50 can be employed while still obtaining high strength joints. The electron beam welding process is further advantageous in that it is a fusion process that can be used with materials that are not necessarily easily welded using older conventional welding techniques. Thus, the material for walls 38, 40, and 50 can be selected on the basis of the wall function rather than welding requirements. Electron beam welding is described at pages 267 through 272 in "Welding Skills and Practices" published by American Technical Society in Chicago, Ill.

As previously noted, the hollow panel is internally pressurized with fire-suppressant to a pressure in the neighborhood of 900 p.s.i. The partitions 50 are provided with ports or openings 52 at regularly spaced points therealong to provide essentially a single chamber for containing the pressurized fire-suppressant. The openings 52 are sized to present relatively slight resistance to flow toward the opening formed by the enemy projectile as it passes through fuel tank 18, and walls 38 and 40. The invention is not directly concerned with the type of fire-suppressant material charged into panel 36. However, a preferred material is $CF_3Br$, one commercial form thereof being sold under the trademark Halon 1301. The charging operation may be directed through a fitting or boss 54 containing a non-illustrated check valve that prevents escape of suppressant material after the charging line is disconnected from the fitting.

Panel 36 is mounted with its bowed wall 38 as near as possible to tank wall 30. In fact, a preferred arrangement would include a merger of walls 38 and 30 into one single wall. However manufacturing considerations make such a merger difficult to achieve. The illustrated panel is mounted on the fuel tank via lugs 31 projecting from the fuel tank near its bottom edge, lugs 33 projecting from the fuel tank near its upper edge, and one or more steel straps or bands 37 having hinge-type connections 35 with the lugs. The lower lugs 31 support the panel weight; the steel straps prevent the panel from being blown away from the fuel tank by the enemy projectile as it passes through the tank in a right-to-left direction.

Preferably the steel straps are placed under relatively high tension to prevent significant movement of panel 36 away from wall 30 during passage of a projectile through the tank. Such movement is potentially possible by reason of pressurized suppressant leakage through the wall 30, 38 interface. Thus, as the projectile forms an opening in wall 38 some of the pressurized suppressant tends to flow through that opening and against the face of wall 30, thus creating a force tending to separate the panel from the fuel tank. Straps 37 resist the separation tendency. However, any separation that does occur is a bodily movement of the panel rather than a deformation of the panel. Therefore, high pressure fluid within the wall 30, 38 interface can escape without blowing the panel a significant distance away from the fuel tank.

Walls 38 and 40 are preferably formed of a material that will not easily fragment when struck by a projectile. For example, wall 40 should not splinter into fragments that could injure or kill human beings sitting or standing in space 22. The opening formed by the enemy projectile should be relatively well defined without massive failure of the wall in a fragmenting action. A preferred material for the panel walls 38, 40, 42 and 50 is stainless steel designated 17-7PH (precipitation hardening). A fabricated hollow panel formed of this material (by electron beam welding processes) can be placed in an oven at 1100° F. and slowly cooled or aged to develop satisfactory hardness and yield strength without warpage. The hardness of such a panel after aging is in the range of 38 to 42 on the Rockwell C scale; the yield strength is about 200,000 p.s.i.

The various walls of the hollow panel can vary dimensionwise. However, as an example walls 38, 40 and 50 would usually be less than 0.100 inches thick, e.g. 0.06 inch thick. Walls 38 and 40 would be spaced apart about one inch, and partitions 50 would be spaced apart 1½ inch. Walls 38 and 40 can each have a radius of curvature (bow) of about 5 feet.

It is not believed essential to have the fire-suppressant panel located outside the fuel tank. For example, as shown in FIG. 5, the panel can be located within the fuel tank. The panel must of course be welded or otherwise secured to tank wall 30 prior to final assembly of the tank components. As shown, the fuel tank is formed of two tank half sections joined together on peripheral line 56 after placement of panel 36 on tank wall 30.

The primary feature of interest in connection with panel 36 is the double direction burst protection provided by partitions 50 and the curvature of walls 38 and 40. The construction enables relatively large panels to be used while still having satisfactory protection against premature bursting by the internal pressure. Partitions 50 also have an advantageous anti-fragmentation action while a projectile is passing through the panel. Thus the welded joints between the partitions and rear wall 40 tend to keep the wall intact (except at the opening formed by the projectile), thereby minimizing dangerous fragmentation.

Various changes or modifications may be made in the panel in accordance with the size of the fuel tank and the nature of the fire-suppressant being used. The inventive features are recited and identified in the appended claims.

I wish it to be understood that I do not desire to be limited to the exact details of construction shown and described for obvious modifications will occur to a person skilled in the art.

I claim:

1. In a military vehicle equipped with a rectangular fuel tank having an outboard major wall (28) and an inboard major wall (30), said inboard wall being bowed so that its external surface has a convex curvature; a hollow panel (36) containing highly pressurized fire-suppressant material; said hollow panel being located against the inboard major wall of the tank in the path that an enemy projectile would take during passage through the tank major walls, whereby an opening formed in the panel by the projectile discharges pressurized suppressant out of the panel: the improvement wherein the hollow panel comprises first and second parallel bowed walls (38 and 40) connected at their peripheries by an endless strip (42) that seals the circumscribed space between said bowed walls; said first and second walls being bowed along the minor axis dimension (48) and being flat along the major axis dimension (46); a number of regularly spaced partitions (50) extending between the bowed walls in directions paralleling the major axis dimension; each partition having its edges welded to the bowed walls; each partition having ports (52) spaced therealong for passing pressurized suppressant to the openings formed by the enemy projectile; the bowed nature of the parallel walls (38 and 40) being such that one external face of the panel has a concave curvature and the other external face of the panel has a convex curvature; said panel being oriented so that its concave face mates against the convex surface of the fuel tank; the bowed walls of the panel being spaced apart approximately 1 inch; said partitions (50) being spaced apart about 1½ inch; the panel being formed of stainless steel that is precipitation hardened to have a yield strength of approximately 200,000 p.s.i.; tensioned steel strap means (37) extending along the convex face of the panel; and means anchoring the ends of the steel strap means to the fuel tank so that the panel is restrained against separation from the tank.

* * * * *